US011032890B1

(12) United States Patent
Lu et al.

(10) Patent No.: US 11,032,890 B1
(45) Date of Patent: Jun. 8, 2021

(54) DIMMABLE LAMP SWITCH CONTROL DEVICE

(71) Applicant: Xiamen PVTECH Co., Ltd., Fujian (CN)

(72) Inventors: Fuxing Lu, Fujian (CN); Rongtu Liu, Fujian (CN)

(73) Assignee: Xiamen PVTECH Co., Ltd., Fujian (CN)

( * ) Notice: Subject to any disclaimer, the term of this patent is extended or adjusted under 35 U.S.C. 154(b) by 0 days.

(21) Appl. No.: 17/022,049

(22) Filed: Sep. 15, 2020

(30) Foreign Application Priority Data

Aug. 4, 2020 (CN) ..... 202021590642.9

(51) Int. Cl.
*H05B 45/10* (2020.01)
*H05B 45/50* (2020.01)
*H05B 45/345* (2020.01)
*H05B 45/325* (2020.01)

(52) U.S. Cl.
CPC ..... *H05B 45/50* (2020.01); *H05B 45/10* (2020.01); *H05B 45/325* (2020.01); *H05B 45/345* (2020.01)

(58) Field of Classification Search
CPC ..... H05B 47/00; H05B 45/00; H05B 45/10; H05B 45/30; H05B 45/325; H05B 45/345
See application file for complete search history.

(56) References Cited

U.S. PATENT DOCUMENTS

2014/0062323 A1* 3/2014 Pan ..... H05B 45/395 315/200 R
2019/0041008 A1* 2/2019 Xiong ..... F21V 29/70

* cited by examiner

*Primary Examiner* — Jimmy T Vu
(74) *Attorney, Agent, or Firm* — Winston Hsu

(57) ABSTRACT

The invention is a dimmable lamp switch control device, including: a rectifier bridge module is connected to the conductive pin sets and can enter at least one voltage signal. A filter circuit module has a circuit guard unit connects to a backflow prevention steady voltage filter circuit module, which can play a role in surge voltage absorption and prevent damage from excessive surge voltage connected to the output of a backflow prevention steady voltage filter circuit module. A PWM dimming control unit of a buck-boost constant current module is connected to the dimming signal identification and control circuit module for dimming control. An anti-electricity shock detection control circuit module based on the output signal of the rectifier bridge module to reduce the PWM signal of the buck-boost constant current module to avoid a greater electric shock currents.

6 Claims, 4 Drawing Sheets

DIMMABLE LAMP SWITCH CONTROL DEVICE

CROSS REFERENCE TO RELATED APPLICATION

This application claims priority to China Patent Application No. 202021590642.9, filed 2020 Aug. 4, and included herein in its entirety.

BACKGROUND OF THE INVENTION

1. Field of the Invention

The present invention relates to a switch control device, referring in particular to a dimmable lamp switch control device.

2. Description of the Prior Art

As the product access threshold is constantly upgrading, the traditional LED lamp has been unable to adapt to the new product access standards, from the mandatory dimming upgrade to must have dimming function must also meet the anti-electric shock protection function. In the wire dimming lamp program, because the lamp at both ends of the four pins have a specific input power supply function, so in the biggest cost consideration do not use wireless dimming and power carrier program, wire dimming program needs to solve the following two problems:

1. how to supply the dimming signal through the AC input to the four pins to the internal control circuit of the lamp.
2. how to ensure that the internal anti-leakage control circuit of the lamp can work properly when the feedback of the dimming signal through the AC input power supply pin.

These are two problems that designers need to overcome and solve.

How to solve the above problems is the problem that the relevant industry must think about.

SUMMARY OF THE INVENTION

In view of the above-mentioned problems, the invention provides a dimmable lamp switch control device, comprises: two conductive pin sets, which are formed at both ends of the lamp and electrically connected to a AC power; a rectifier bridge module, which connects the conductive pin sets to input at least one voltage signal; a dimming signal identification and control circuit module having an input and an output, being identifying a dimming signal and controlling the dimmable lamp; a filter circuit module, which connects the rectifier bridge module for outputting a smooth DC voltage, the filter circuit module is equipped with a circuit guard unit and a backflow prevention steady voltage filter circuit module with an output, the circuit guard unit is connected to the output of the backflow prevention steady voltage filter circuit module; a power supply circuit module, which is connected to the output of the backflow prevention steady voltage filter circuit module and the input of the dimming signal identification and control circuit module; a buck-boost constant current module connected to the filter circuit module and stepping down or boosting the filtered DC voltage, and connecting to the dimming signal identification and control circuit module for dimming control; and an anti-electricity shock detection control circuit module connected between the rectifier bridge module and the filter circuit module, and having a signal control unit, the rectifier bridge module controlling the buck-boost constant current module through the signal control unit of the anti-electricity shock detection control circuit module, the anti-electricity shock detection control circuit module reducing the PWM signal of the buck-boost constant current module based on the output signal of the rectifier bridge module.

According to a preferred embodiment of the above-mentioned dimmable lamp switch control device, the power supply circuit module provides a constant operating voltage to the input in the dimming signal identification and control circuit module.

According to a preferred embodiment of the above-mentioned dimmable lamp switch control device, the constant operating voltage is defined in the range of 3.3V-10V.

According to a preferred embodiment of the dimmable lamp switch control device, each of the conductive pin sets comprises two conductive pins, respectively.

According to a preferred embodiment of the above-mentioned dimmable lamp switch control device, the input signal of the dimming signal identification and control circuit module comes from any two conductive pin sets of the conductive pin sets.

According to a preferred implementation of the above-mentioned dimmable lamp switch control device, the dimming signal identification and control circuit module includes an output, wherein the output is connected to a PWM dimming control unit in the buck-boost constant current module, which is dimmable by changing the duty cycle of the PWM signal on the PWM dimming control unit.

In summary, the dimmable lamp switch control device according to the present invention embodiment has the following features:

1, the dimming signal identification and control circuit module receives the input signal transmitted via any two conductive pins of the conductive pin sets, and the dimming signal identification and control circuit module includes an output connected to the PWM dimming control unit in the buck-boost constant current module, and change the duty cycle of the PWM signal on the PWM dimming control unit for dimming.

2. the anti-electricity shock detection control circuit module is connected between the rectifier bridge module and the filter circuit module. The rectifier bridge module controls the buck-boost constant current module through the signal control unit in the anti-electricity shock detection control circuit module, the anti-electricity shock detection control circuit module reduces the buck-boost constant current module according to the output signal of the rectifier bridge module, the anti-electricity shock detection control circuit module reduces the buck-boost constant current module according to the output signal of the rectifier bridge module to avoid generating a larger electric shock current.

3. The circuit guard unit connected to the backflow prevention steady voltage filter circuit module can play a surge voltage absorption function to avoid excessive surge voltage damage to the circuit connected to the output of the backflow prevention steady voltage filter circuit module.

Compared with the traditional complex wireless dimming, power carrier dimming or thyristor dimming schemes, the invention is easier and less costly to implement, and the difficulty of use and operation is most similar to the existing usage.

These and other objectives of the present invention will no doubt become obvious to those of ordinary skill in the art after reading the following detailed description of the preferred embodiment that is illustrated in the various figures and drawings.

DETAILED DESCRIPTION

In order to illustrate in detail the technical content of the technical solution, the construction features, the achieved purpose and effect, the following is explained in detail with specific examples and with the accompanying drawings.

Figure 1:
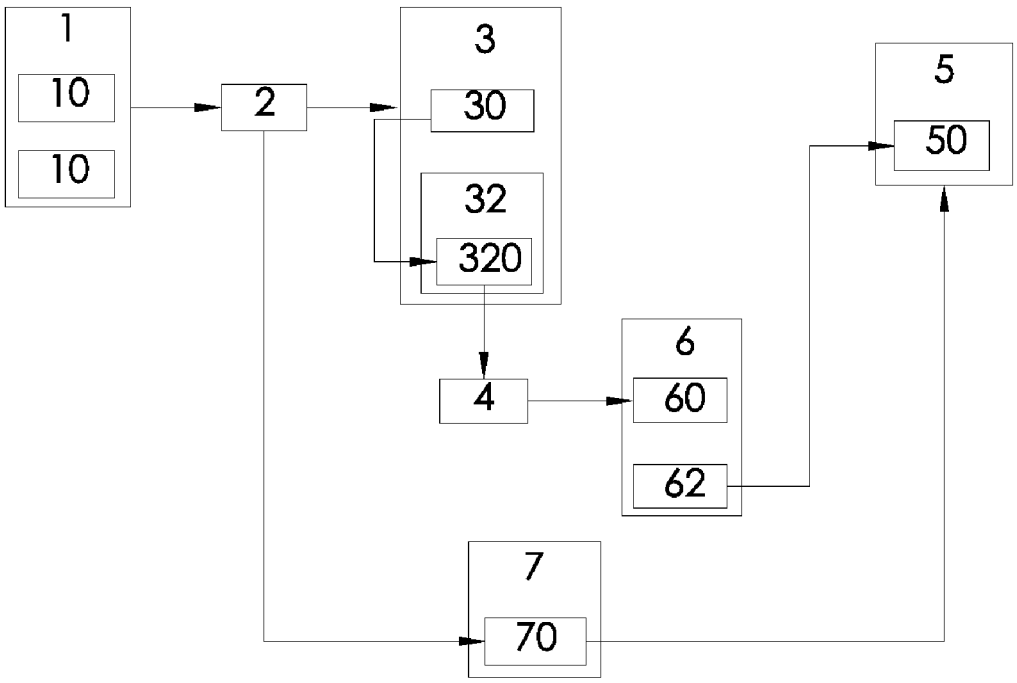
FIG. 1 is a schematic diagram of the dimmable lamp switch control device of the invention.

Please refer to FIG. 1, is a better example of the block diagram of the invention. The invention is a dimmable lamp switch control device, including: two conductive pin sets 1, rectifier bridge module 2, filter circuit module 3, power supply circuit module 4, buck-boost constant current module 5, dimming signal identification and control circuit module 6 and anti-electricity shock detection control circuit module 7. Each of the conductive pin sets 1 includes two conductive pins 10. That is, a lamp with four conductive pins 10. The filter circuit module 3 is connected to the rectifier bridge module 2 for outputting smooth DC voltage, the filter circuit module 3 is equipped with a circuit guard unit 30 and an backflow prevention steady voltage filter circuit module 32 with an output of 320. The circuit guard unit 30 is connected to the output of 320 of the backflow prevention steady voltage filter circuit module 32, so as to function as a surge voltage absorption function to prevent damage to the circuit connected to the output 320 of the backflow prevention steady voltage filter circuit module 32 by an excessive surge voltage.

In addition, the power supply circuit module 4 connects the output 320 of the backflow prevention steady voltage filter circuit module 32 and a input 60 of the dimming signal identification and control circuit module 6. The buck-boost constant current module 5 connects the filter circuit module 3 to buckles or boosts the filtered DC voltage, and connects the dimming signal identification and control circuit module 6 for dimming control. The anti-electricity shock detection control circuit module 7 is connected between the rectifier bridge module 2 and the filter circuit module 3. The rectifier bridge module 2 controls the buck-boost constant current module 5 through the signal control unit 70 in the anti-electricity shock detection control circuit module 7. The anti-electricity shock detection control circuit module 7 reduces the PWM signal of the buck-boost constant current module 5 based on the output signal of the rectifier bridge module 2.

The power supply circuit module 4 in the foregoing provides a constant operating voltage to the input 60 of the dimming signal identification and control circuit module 6. The constant operating voltage is defined between 3.3V and 10V.

The input signal of the dimming signal identification and control circuit module 6 comes from any three of the four conductive pins 10. The dimming signal identification and control circuit module 6 includes an output 62. The output 62 is connected to the PWM dimming control unit 50 of the buck-boost constant current module 5, by changing the duty cycle of the PWM signal on the PWM dimming control unit 50 for dimming control.

Figure 2:
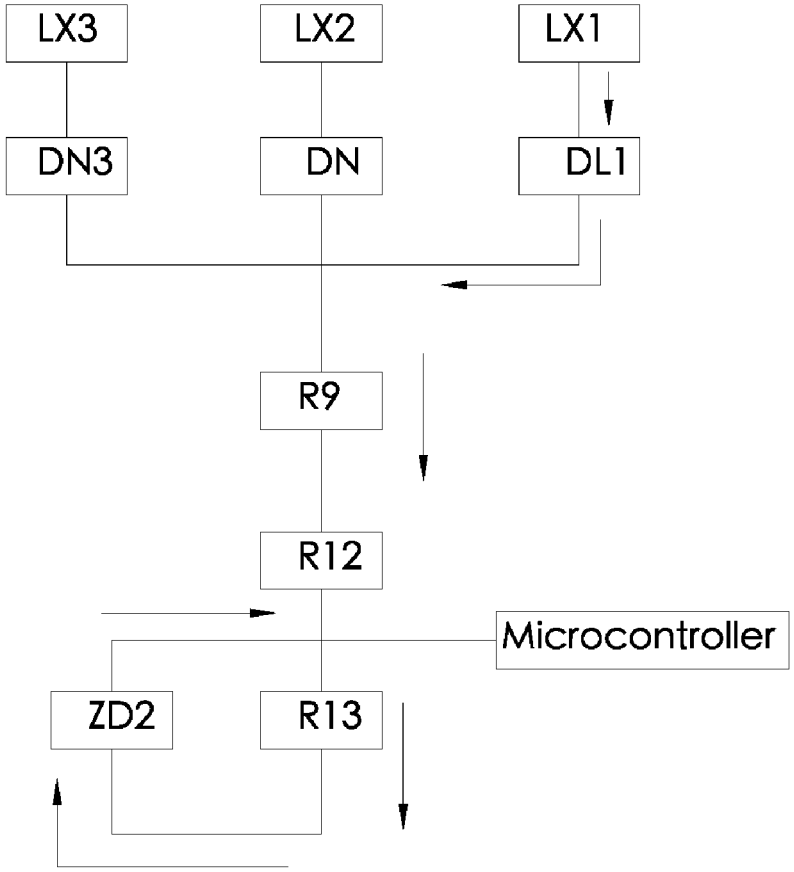
FIG. 2 is a schematic diagram of the dimmable lamp switch control device of the invention.

With reference to FIG. 2, the dimming input recognition signal pins LX1 LX2 LX3 of the dimming signal identification and control circuit module 6 are connected to two AC input rectifier bridge module 2, and any three connection of four conductive pins 10. Therefore, when there is an AC voltage input, the electrical signal is transmitted through at least one circuit of the dimming input recognition signal pin LX1 LX2 LX3 and feedback to the microcontroller. The path LX1, DL1, R9, R12, ZD2, R13 (arrow direction) produces a voltage that the microcontroller can identify at both ends of R13. The voltage is generally designed to be greater than ⅓ of the microcontroller voltage.

Figure 3:
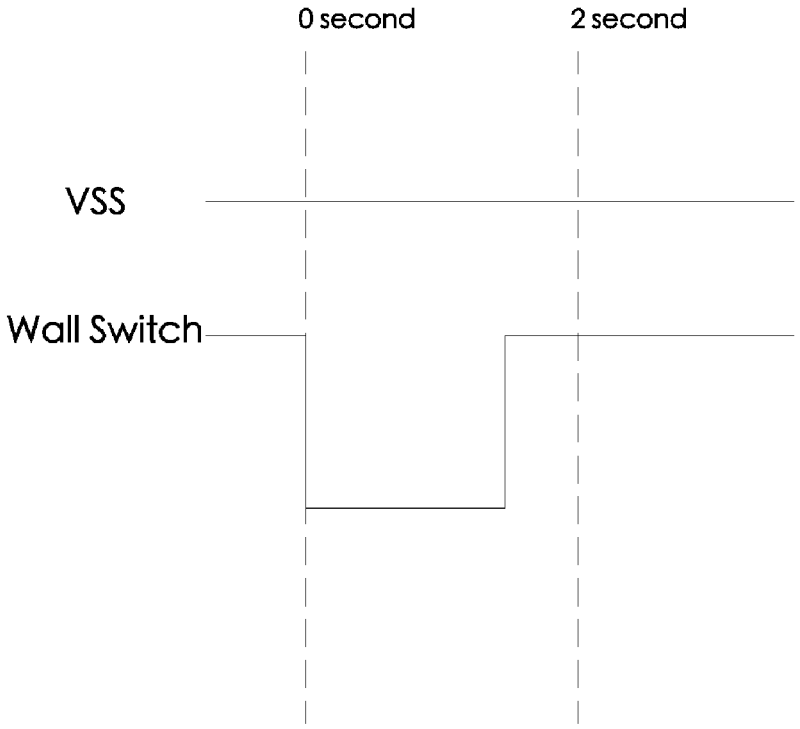
FIG. 3 is a timing diagram of the effective dimming signal definition of the invention.
Figure 4:
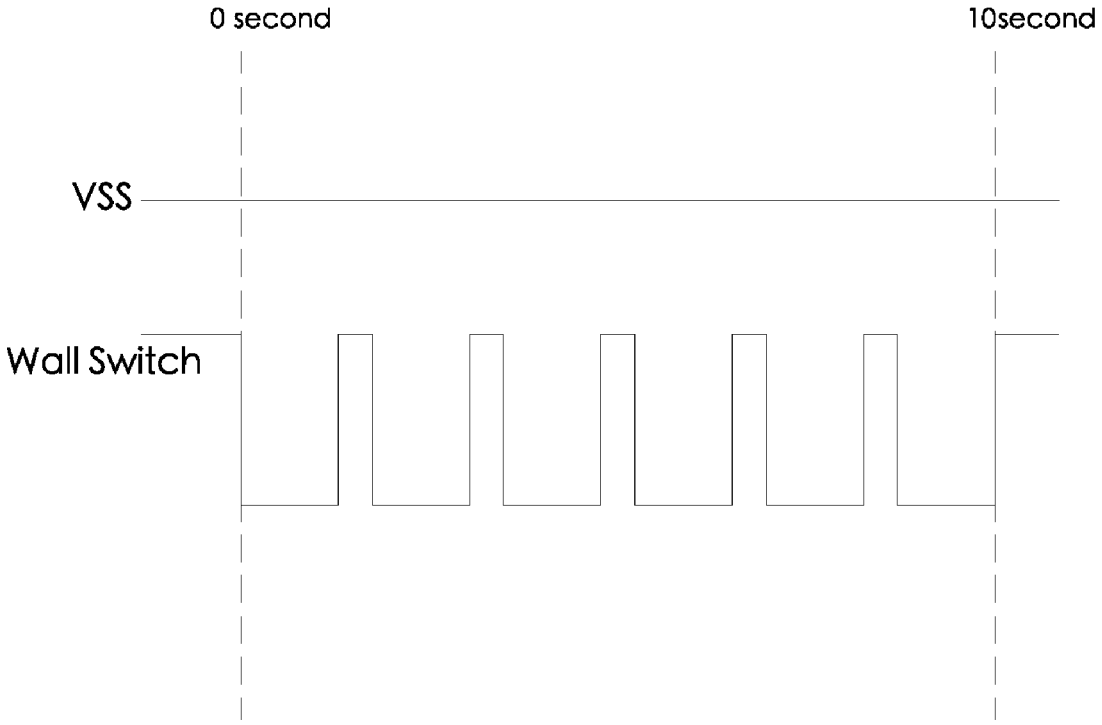
FIG. 4 is a timing diagram of the effective dimming signal operation in the dimming mode of the invention.

Referring to FIG. 3 and FIG. 4 together, the timing diagram of the effective dimming signal definition and the timing diagram of the effective dimming signal operation in the dimming mode of the invention are shown in FIG. 3 and FIG. 4 respectively.

The above effective dimming signal is defined as a wall switch that switches from a closed state to an open state and then from an open state to a closed state within a predetermined time (e.g., within 2 seconds) (refer to FIG. 3).

The PWM dimming control unit 50 normally switches to dimming mode in normal mode when an effective dimming signal is received.

In dimming mode, the wall switch is switched from the closed state to the open state and then from the open state to the closed state to switch N times and the time does not exceed N*2 seconds, N is greater than 1 time. The PWM signal in the dimming mode will change incrementally from 5% to 100% and will stay for 1 second after increasing by 5%.

After entering the dimming mode, no effective dimming signal appears during the incremental change of PWM signal from 5% to 100%, then the PWM output returns to the state before entering the dimming mode (refer to FIG. 4).

The function of effective dimming signal is that during the 5%-100% incremental change of the PWM signal in dimming mode, when the effective dimming signal is present, the PWM output duty cycle remains at the duty cycle when the effective dimming signal is present, and the PWM signal determines the brightness of the lamp.

As can be seen from the above, the dimmable lamp switch control device of the invention, with the following features:

1, the input signal is from any three of the conductive pin sets, and dimming signal identification and control circuit module includes an output, which is connected to the PWM dimming control unit of the buck-boost constant current module, by changing the PWM signal duty cycle of the PWM Dimming control unit, dimming is easily operated.

2, the rectifier bridge module controls the buck-boost constant current module through the signal control unit of the anti-electricity shock detection control circuit module, and the anti-electricity shock detection control circuit module based on the output signal of the rectifier bridge module to reduce the PWM signal of the buck-boost constant current module to avoid a greater electric shock currents.

3, the circuit guard unit is connected to the backflow prevention steady voltage filter circuit module to absorb surge voltage and avoid excessive surge voltage damage to the circuit connected to the output of the backflow prevention steady voltage filter circuit module.

Compared with the complex wireless dimming, power carrier dimming or traditional thyristor dimming, the dimmable lamp switch control device of the invention is easier to implement and more efficient.

The invention is easy and inexpensive to implement, and the use and operation is most similar to the existing usage.

It should be noted that, although the above-mentioned examples have been described in this paper, this does not limit the scope of patent protection of the present invention. Therefore, based on the innovative concept of the invention, the changes and modifications made to the examples described herein, or the equivalent structure or equivalent process transformations made by using the contents of the specification and drawings of the invention to apply the above technical solutions directly or indirectly to other related technical fields are all included in the scope of protection of the invention patent.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A dimmable lamp switch control device, comprising:

two conductive pin sets being respectively formed at both ends of the lamp and electrically connected to a AC power supply;

a rectifier bridge module being connected to the conductive pin sets to input at least one voltage signal;

a dimming signal identification and control circuit module having an input and an output, being identifying a dimming signal and controlling the dimmable lamp;

a filter circuit module connected to the rectifier bridge module for outputting a smooth DC voltage, the filter circuit module being provided with a circuit guard unit and a backflow prevention steady voltage filter circuit module, the circuit guard unit being connected to the output of the backflow prevention steady voltage filter circuit module;

a power supply circuit module connected to the output of the backflow prevention steady voltage filter circuit module and a input of the dimming signal identification and control circuit module;

a buck-boost constant current module connected to the filter circuit module and stepping down or boosting the filtered DC voltage, and connecting to the dimming signal identification and control circuit module for dimming control; and an anti-electricity shock detection control circuit module connected between the rectifier bridge module and the filter circuit module, and having a signal control unit, the rectifier bridge module controlling the buck-boost constant current module through the signal control unit of the anti-electricity shock detection control circuit module, the anti-electricity shock detection control circuit module reducing the PWM signal of the buck-boost constant current module based on the output signal of the rectifier bridge module.

2. The dimmable lamp switch control device as claimed in claim 1, wherein the power supply circuit module provides a constant operating voltage to the input of the dimming signal identification and control circuit module.

3. The dimmable lamp switch control device as claimed in claim 2, wherein the constant operating voltage is defined in the range of 3.3V-10V.

4. The dimmable lamp switch control device as claimed in claim 1, wherein each of the conductive pin sets respectively including two conductive pins.

5. The dimmable lamp switch control device as claimed in claim 4, wherein the input signal of the dimming signal identification and control circuit module is transmitted via any two of the conductive pins.

6. The dimmable lamp switch control device as claimed in claim 5, wherein the dimming signal identification and control circuit module includes an output, wherein the output is connected to a PWM dimming control unit in the buck-boost constant current module, which is dimmable by changing the duty cycle of the PWM signal on the PWM dimming control unit.

* * * * *